US008590173B1

(12) United States Patent
Mengle

(10) Patent No.: US 8,590,173 B1
(45) Date of Patent: Nov. 26, 2013

(54) SYSTEM FOR FILTER DRYING USING MICROWAVE ENERGY

(76) Inventor: Tobi D. Mengle, Birdsboro, PA (US)

( * ) Notice: Subject to any disclaimer, the term of this patent is extended or adjusted under 35 U.S.C. 154(b) by 338 days.

(21) Appl. No.: 13/037,747

(22) Filed: Mar. 1, 2011

Related U.S. Application Data

(60) Provisional application No. 61/340,149, filed on Mar. 15, 2010.

(51) Int. Cl.
*F26B 21/06* (2006.01)

(52) U.S. Cl.
USPC ..... 34/259; 34/265; 209/390; 209/402; 219/679; 219/690; 156/64; 156/275.5; 423/45; 438/795; 585/1

(58) Field of Classification Search
USPC ..... 34/259, 265; 208/14, 390, 402; 219/679, 690, 702; 156/64, 275.5, 293; 423/45; 438/795; 585/1
See application file for complete search history.

(56) References Cited

U.S. PATENT DOCUMENTS

| | | | | | |
|---|---|---|---|---|---|
| 3,434,220 | A * | 3/1969 | Forster | 34/264 |
| 3,771,234 | A * | 11/1973 | Forster et al. | 34/259 |
| 3,854,219 | A * | 12/1974 | Staats | 34/265 |
| 3,858,329 | A * | 1/1975 | Koide et al. | 34/265 |
| 3,958,340 | A * | 5/1976 | Meyers | 34/259 |
| 4,055,001 | A * | 10/1977 | Forster et al. | 34/264 |
| 4,882,851 | A * | 11/1989 | Wennerstrum et al. | 34/60 |
| 4,958,443 | A * | 9/1990 | Haueter et al. | 34/593 |
| 4,962,592 | A * | 10/1990 | Orizand | 34/263 |
| 5,105,555 | A * | 4/1992 | Nakagomi | 34/259 |
| 5,174,042 | A * | 12/1992 | Tomizawa et al. | 34/259 |
| 5,187,879 | A * | 2/1993 | Holst | 34/261 |
| 5,285,581 | A * | 2/1994 | Walker | 34/500 |
| 5,315,765 | A * | 5/1994 | Holst et al. | 34/260 |
| 5,321,897 | A * | 6/1994 | Holst et al. | 34/260 |
| 5,388,345 | A * | 2/1995 | Brundage et al. | 34/256 |
| 5,606,804 | A * | 3/1997 | Smith et al. | 34/261 |
| 6,092,924 | A * | 7/2000 | Scalese et al. | 374/14 |
| 6,094,835 | A * | 8/2000 | Cromer | 34/80 |
| 6,463,674 | B1 * | 10/2002 | Meyers et al. | 34/304 |
| 7,017,278 | B2 * | 3/2006 | Kato | 34/259 |
| 7,332,057 | B2 * | 2/2008 | Isom et al. | 159/47.1 |
| 2006/0206103 | A1 * | 9/2006 | Altshuler et al. | 606/9 |
| 2007/0079523 | A1 * | 4/2007 | Kimrey, Jr. | 34/79 |
| 2009/0152179 | A1 | 6/2009 | Kopperschmidt | |
| 2010/0025304 | A1 * | 2/2010 | Everleigh et al. | 208/402 |
| 2010/0069688 | A1 * | 3/2010 | Pringle et al. | 585/1 |
| 2010/0301770 | A1 * | 12/2010 | Chemel et al. | 315/294 |
| 2011/0192989 | A1 * | 8/2011 | Yaniv et al. | 250/453.11 |
| 2011/0297670 | A1 * | 12/2011 | Caggiano | 219/687 |
| 2012/0198718 | A1 * | 8/2012 | Odueyungbo | 34/60 |
| 2013/0056987 | A1 * | 3/2013 | Novak | 290/52 |
| 2013/0075390 | A1 * | 3/2013 | Ashida | 219/702 |

* cited by examiner

*Primary Examiner* — Steve M Gravini
(74) *Attorney, Agent, or Firm* — Wendy W. Koba

(57) ABSTRACT

A microwave source is used in conjunction with a waveguide and microwave window aperture to direct controlled microwave energy into the housing of a filter. The microwave energy will heat and vaporize any fluid present on the filter material, preventing the filter from "wetting" and becoming unusable.

11 Claims, 3 Drawing Sheets

SYSTEM FOR FILTER DRYING USING MICROWAVE ENERGY

CROSS-REFERENCE TO RELATED APPLICATIONS

This application claims the benefit of U.S. Provisional Application No. 61/340,149, filed Mar. 15, 2010, and herein incorporated by reference.

TECHNICAL FIELD

The present invention relates to a system for drying filters used in industrial applications and, more particularly, to the use of a microwave energy element to perform the drying operation.

BACKGROUND OF THE INVENTION

Hydrophobic gas filters are used for inlet gas and vent filters on fermentors and bioreactors, as well as other process equipment. Hydrophobic filters will not wet in water but will wet in low surface tension liquids, for example, organic solvents such as alcohols. Once a hydrophobic filter has been wetted, aqueous solutions also will pass through. Hydrophobic filters are best suited for gas filtration and venting arrangements. In certain applications, hydrophobic filters are used to filter aqueous solutions because of compatibility requirements. Water or aqueous solutions can also pass through a hydrophobic filter once the water breakthrough pressure is reached.

When used with a fermentor, a vent filter is subjected to high volume and/or continuous flow rates of gases that have passed through a culture medium. As a result, these gases typically have high humidity levels and often entrain droplets of the culture media. When this humid gas stream passes through a hydrophobic filter, it deposits some of the entrained fluid on (or within) the filter material and hence begins "wetting" the filter material. Since the material is hydrophobic, as the fluid wets the filter, its ability to pass the gas stream diminishes, until eventually the filter becomes blocked with fluid and will no longer allow the gas to pass through. This decreasing flow capacity causes problems with the pressure control, as well as gas inlet flow, on the fermentor until it reaches a point where pressure control is no longer possible and the current fermentation batch is lost. This has been a problem in the biotechnology industry for years and also applies to bioreactors and the filters associated with their processes. Many other processes, such as in the medical field, utilize hydrophobic filters and need to constantly monitor and/or change the filter elements to overcome the wetting problem.

Attempts to solve this problem in the prior art have used pre-filter vent gas heaters, pre-filter vent gas condensers, steam jacketed filter housings and external electric heaters for the filter housing. The condensers attempt to remove the moisture, while the pre-heaters attempt to vaporize the moisture, prior to entering the filter. Both of these options are relatively expensive and must be "sized" for each application on a case-by-case basis. Indeed, the condensers and pre-heaters often become large and expensive for high glass flow rate applications. Steam jacketed filter housings and external electric heaters suffer from the large physical gap between the filter element and the housing, which typically has a high flow rate gas passing through it, providing a large thermal barrier to heat transfer from the external heater to the filter element.

Thus a need remains in the art for a system that provides the desired drying to the filters without the size limitations and marginal effectiveness of the prior art.

SUMMARY OF THE INVENTION

The needs remaining in the prior art are addressed by the present invention, which relates to a system for drying filters used in industrial applications and, more particularly, to the use of a microwave energy element to perform the drying operation.

In accordance with the present invention, a microwave source is used and controlled to radiate a 'wetted' filter (either partially or fully wetted) with microwave energy, causing any accumulated and/or trapped liquids to be vaporized and pass through the system. The microwave drying source may be directly attached to a filter housing, or may be remotely located from the filter housing, with a microwave signal path (e.g., coaxial cable, waveguide or the like) used to safely transmit the microwave energy to the filter housing and provide energy transfer to the housed filter element.

A remotely-located microwave source can be used to supply microwave energy to a plurality of distributed filters, providing drying to a number of separate filtration systems from a single source.

In a preferred embodiment of the present invention, safety locks are included with the microwave source, waveguide and filter housing to ensure that the microwave source is only energized when the system is sealed.

While one exemplary embodiment is associated with the drying of hydrophobic filters, the principles of the present invention are applicable for use with any type of industrial filter where liquid particles may adhere to or become entrapped in the filter material and adversely impact the performance of the filtering element.

Other and further aspects and embodiments of the present invention will become apparent during the course of the following discussion and by reference to the accompanying drawings.

BRIEF DESCRIPTION OF THE DRAWINGS

Referring now to the drawings.

DETAILED DESCRIPTION

Figure 1:
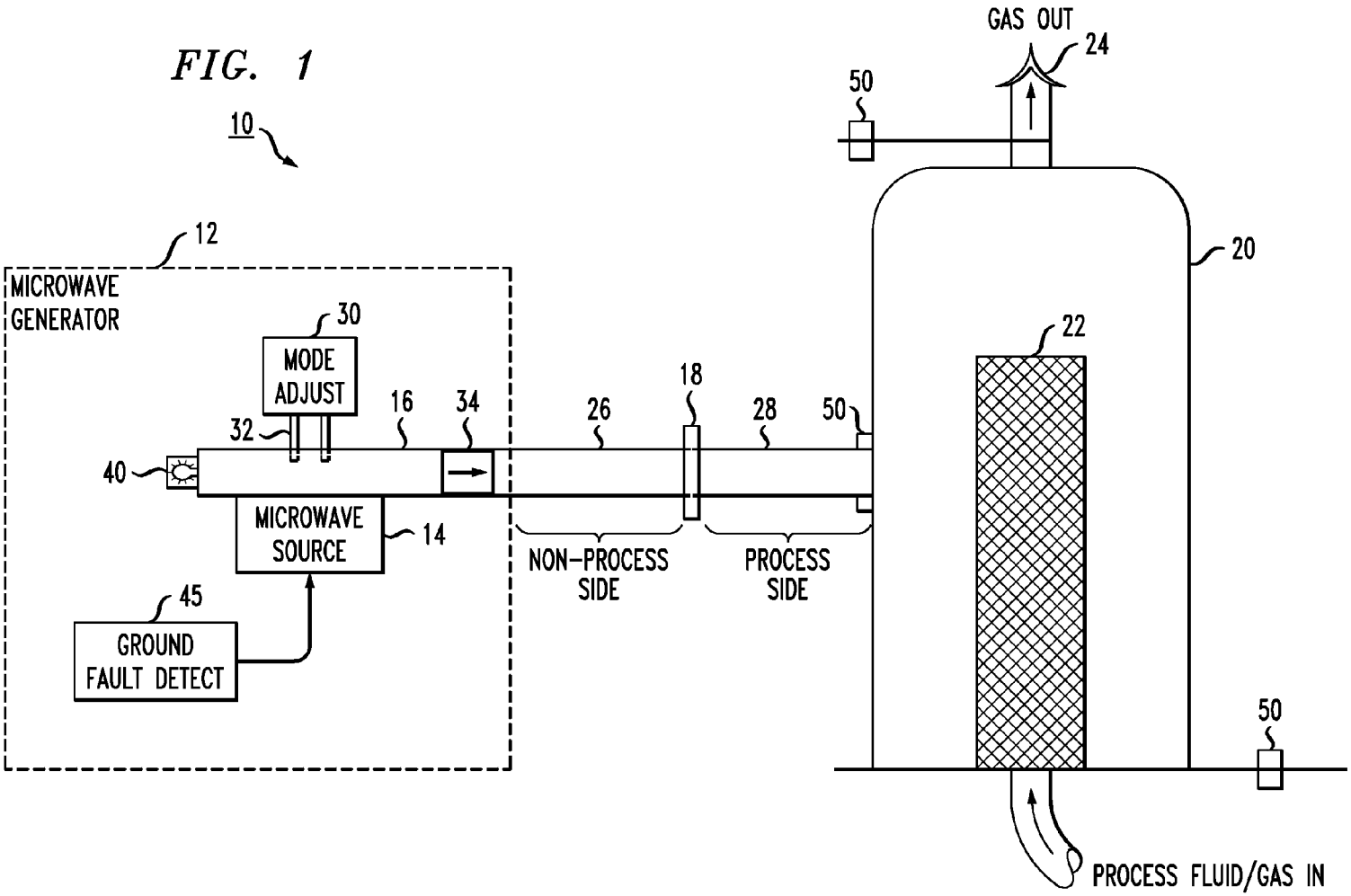
FIG. 1 illustrates an exemplary microwave filter dryer apparatus formed in accordance with the present invention.

A microwave source is used in conjunction with a waveguide and microwave window aperture to direct controlled microwave energy into the filter housing. The microwave energy will heat and vaporize any fluid present on the filter material. FIG. 1 illustrates an exemplary microwave filter dryer 10 formed in accordance with the present invention. As shown, dryer 10 comprises a microwave generator 12 comprising a microwave source 14 that is coupled to a waveguide 16 which supports the propagation of the energy created by microwave source 14. The energy propagating along waveguide 16 then passes through a microwave window/aperture 18 which directs the controlled microwave energy into a filter housing 20 to heat and vaporize any fluid present on filter material 22. The heated/vaporized fluid will then release from filter material 22 and exit filter housing 20 through a housing outlet 24.

In accordance with the present invention, the application of the microwave energy prevents filter 22 from becoming blocked with fluid, as was the case in the prior art.

Electrically-grounded filter housing 20, as well as waveguide 16, serve as containment for the microwave energy (in a manner similar to the radiation-sealed (Faraday cage) cooking chamber in a microwave oven). It has been found that various materials besides the conventional stainless steel may be used for filter housing 20 and will suitably function to contain the microwave energy. Single-use or disposable polymer filter housings have been found suitable, when used in conjunction with a re-usable Faraday cage surrounding the active microwave volume.

Microwave window 18 comprises a material that allows for the microwave radiation to pass from the "non-process" (i.e., input) side 26 of waveguide 16 to the internal "process" side 28 while leaving process side 28 sealed for gas flow and pressure. Microwave window 18 can itself be made from a material such as borosilicate glass or any suitable high temperature polymer. Waveguide 16 may be configured to further include a mode control component 30 that is used to adjust the mode of the propagating microwave energy in a conventional fashion. For example, mode control component 30 may comprise one or more rods (or screws) 32 that are introduced into waveguide 16 to modify the cavity to support the desired propagation mode, resulting in better coupling into the "load" (the load being filter 22 in this case) and reduced reflection back along waveguide 16. An isolator assembly 34 may also be included along waveguide 16 for preventing the propagation of reflected microwave energy in the reverse direction, preventing microwave source 14 from reflected energy in higher power applications (or applications that are difficult to tune with mode control component 30 for minimal reflected power).

In operation, microwave source 14 can remain "off" until needed, or be controlled through various process control arrangements (such as periodic pulses) to clear accumulated fluids. Alternatively, the pressure across filter 22 can be monitored, and microwave source 14 activated when the pressure differential crosses a predetermined threshold.

Preferably, microwave filter dryer 10 is configured to include safety mechanisms that will not allow source 12 to activate unless the containment cavity (i.e., filter housing 20 and waveguide 16) is securely in place. Referring back to FIG. 1, an exemplary safety mechanism takes the form of a visible light interlock 40, where source 12 cannot be activated if there is visible light present in waveguide 16 (indicating the absence of filter housing 20 or improper attachment of waveguide 16). Physical interlock proximity sensors 50, wired in series, may also be used that require filter housing 20 to be mated with microwave window 16 and the gas exiting piping 24.

Microwave generator 12 preferably includes a ground fault detection system 45 to disable microwave source 14 if the electrical system is not complete.

Figure 2:
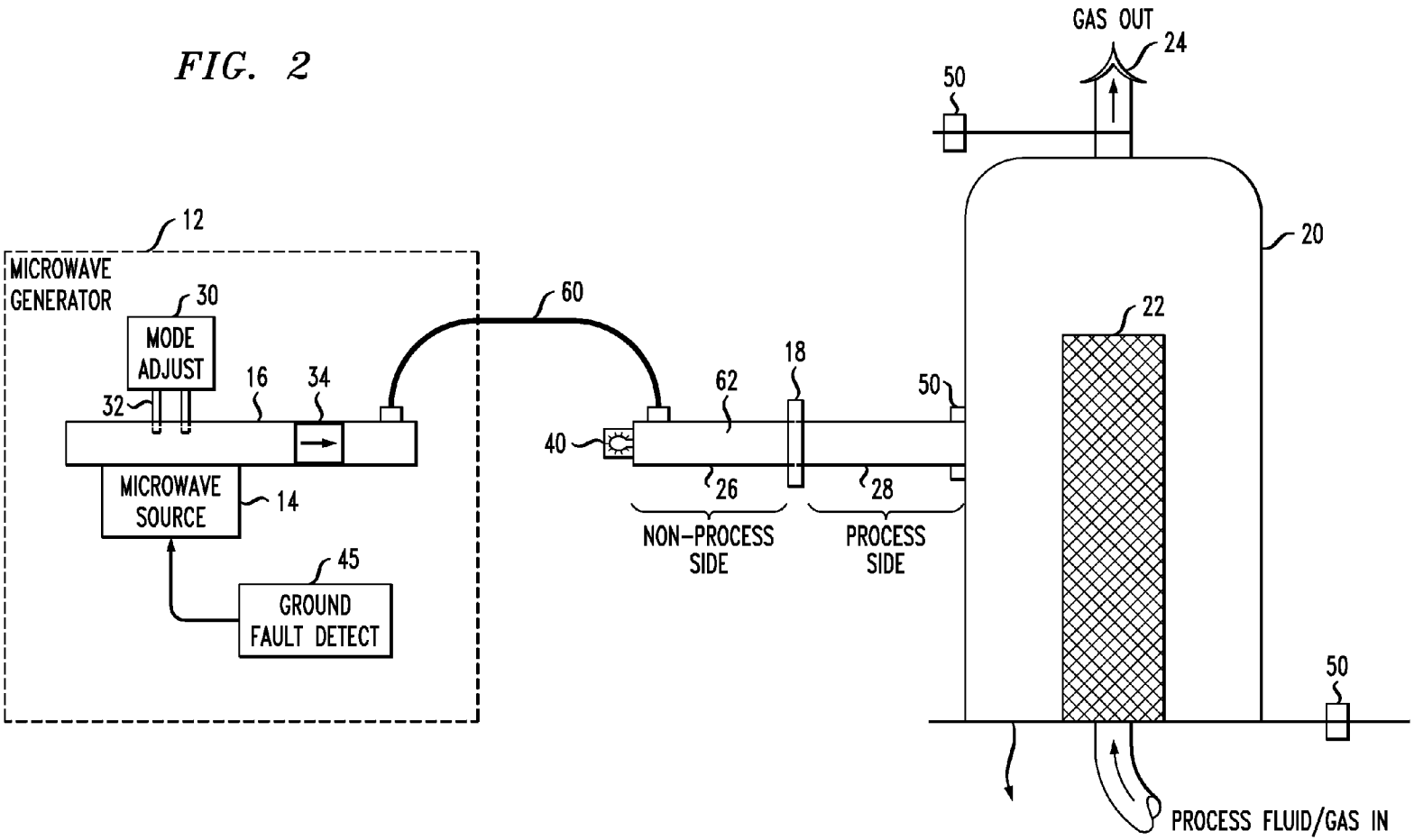
FIG. 2 shows an alternative embodiment of the present invention, where the microwave source is remotely located with respect to the filter and utilizes a microwave signal path to transmit the radiation from the source to the filter housing.

FIG. 2 illustrates an alternative embodiment of the present invention where microwave generator 12 is remotely located from filter housing 20. In this case, a coaxial cable 60 (or a stripline, second waveguide or other suitable microwave transmission line) is used to couple the microwave energy from waveguide 16 to a stub waveguide 62 disposed adjacent to window 18. In this case, visible light interlock 40 is positioned at the termination of stub waveguide 62.

Figure 3:
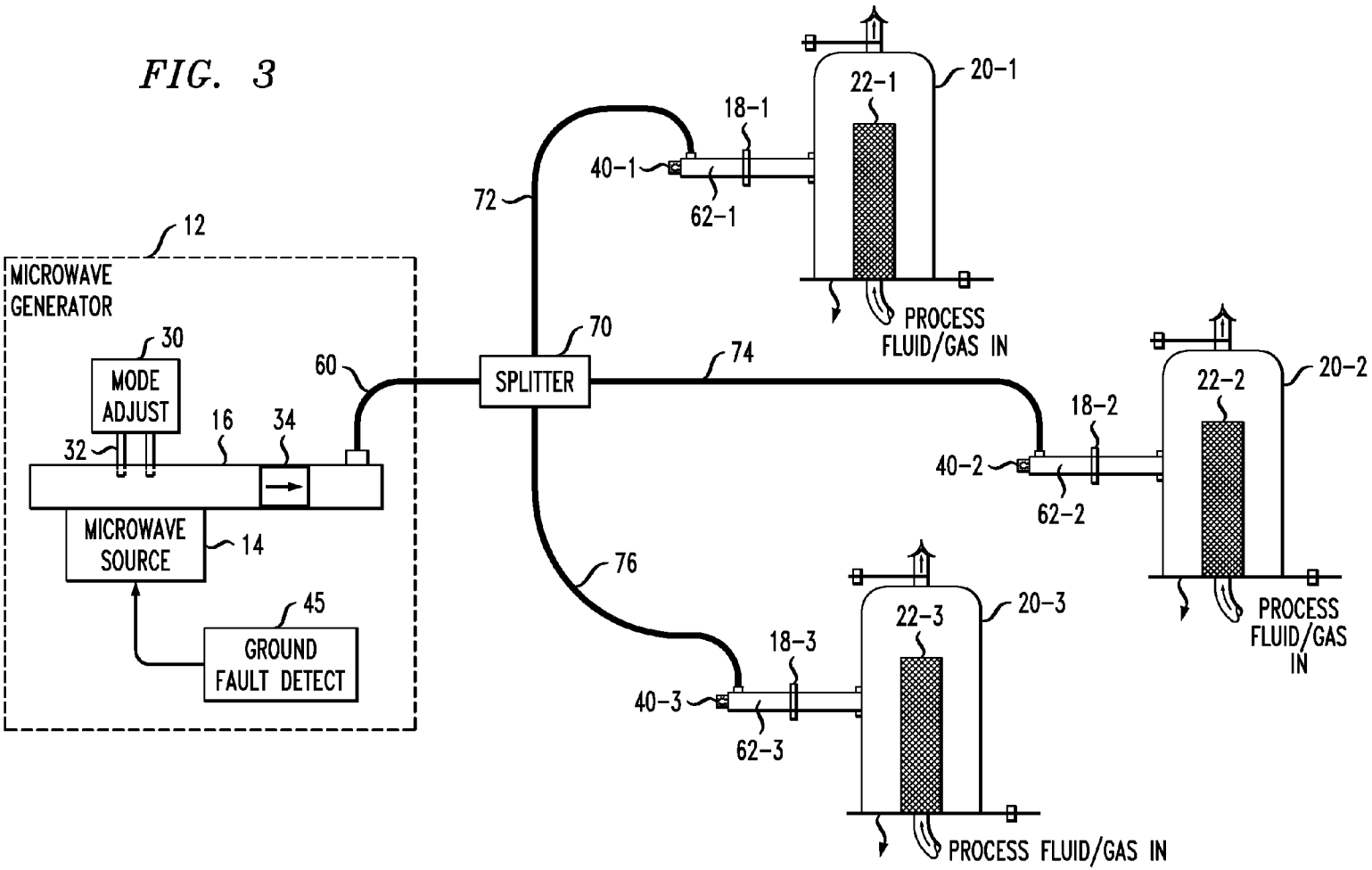
FIG. 3 illustrates a variation of the embodiment of FIG. 2, where a microwave splitting component is used to provide the microwave energy from a single microwave source to a plurality of separate filtering systems.

Indeed, with this remote configuration, it is possible to use a single microwave source to "dry" a number of filters located within different pieces of equipment. FIG. 3 illustrates this configuration. As shown, coaxial cable 60 output from microwave generator 12 passes through a splitter 70 that functions to divide the microwave energy along a number of separate output paths. In this example, the output paths comprise a set of three coaxial cables 72, 74 and 76. Coaxial cable 72 is used to provide the microwave energy to "dry" a first filter 22-1, located in a first housing 20-1. In a similar fashion, coaxial cable 74 is coupled as the microwave input to a stub waveguide 62-2 and used to dry a second filter 22-2. Coaxial cable 76 is connected via stub waveguide 62-3 to dry filter 22-3. While not explicitly shown, it is possible to include a switching arrangement within splitter 70 to control the operation of each of the separate output signals (that is, to control the turning "on" and "off" of the microwave energy to each of the separate filter drying systems).

While various embodiments of the present invention have been illustrated and described, these are considered to be by way of example only and various changes and modifications may be made that are considered to fall within the scope of the present invention. For example, while the microwave filter drying apparatus was initially conceived for use with hydrophobic filters, it is generally applicable to any filtering system where liquids become entrapped or otherwise adhere to the filtering material. Indeed, the scope of the present invention is intended to be limited only by the claims appended hereto.

What is claimed is:

1. An arrangement for drying a filter contained within a filter housing, the arrangement comprising:

a microwave source;

a waveguide coupled between the microwave source and the filter housing, the waveguide for supporting the propagation of microwave energy from the microwave source into the filter housing; and a microwave window disposed along the waveguide to partition the waveguide into an input, non-process side coupled to the microwave source and an output, process side sealed to the filter housing, the microwave window transparent to the microwave energy and used for directing the microwave energy onto the filter contained in the filter housing as a sealed system, the presence of the microwave energy heating and vaporizing any entrained liquid present on the filter and thereby drying the filter.

2. An arrangement as defined in claim 1 wherein the arrangement further comprises a mode tuning component disposed in associated with the microwave source to adjust the mode of the created microwave energy to improve mode coupling between the microwave source and the filter housing.

3. An arrangement as defined in claim 1 wherein the arrangement further comprises an isolator disposed along the waveguide to prevent reflected microwave energy from the filter housing from re-entering the microwave source.

4. An arrangement as defined in claim 1 wherein the arrangement further comprises at least one safety mechanism for disabling the operation of the microwave source when the waveguide and filter housing are improperly joined together.

5. An arrangement as defined in claim 4 wherein the at least one safety mechanism comprises a light indicator disposed at the input, non-process side of the waveguide to disable the operation of the microwave source if the microwave signal path is open.

6. An arrangement as defined in claim 4 wherein the at least one safety mechanism comprises a plurality of physical proximity sensors between each element to ensure the containment of the microwave energy.

7. An arrangement as defined in claim 1 wherein the arrangement is remotely located from the filter housing and further comprises a microwave signal path coupled between a termination of the waveguide and the input, non-process side of the microwave window, the microwave signal path supporting the propagation of microwave energy from the waveguide to the input, non-process side of the microwave window.

8. An arrangement as defined in claim 7 wherein the arrangement further comprises a stub waveguide at the input, non-process side of the microwave window, where the microwave signal path is coupled as an input to the stub waveguide.

9. An arrangement as defined in claim 7 wherein the microwave signal path comprises a coaxial cable.

10. An arrangement as defined in claim 7 wherein the arrangement further comprises a microwave splitter element coupled to an endpoint of the microwave signal path to create a plurality of N microwave output signals, each microwave output signal coupled through a separate one of a plurality of N microwave windows and used to dry a plurality of separate filters located in separate filter housings.

11. An arrangement as defined in claim 1 wherein the arrangement is utilized with a hydrophobic filter.

* * * * *